US009291949B2

(12) United States Patent
Sasaki

(10) Patent No.: US 9,291,949 B2
(45) Date of Patent: Mar. 22, 2016

(54) LIQUID DEVELOPMENT APPARATUS AND WET-TYPE IMAGE FORMING APPARATUS

(71) Applicant: Konica Minolta, Inc., Chiyoda-ku (JP)

(72) Inventor: Kunitomo Sasaki, Takatsuki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/915,838

(22) Filed: Jun. 12, 2013

(65) Prior Publication Data

US 2013/0336678 A1 Dec. 19, 2013

(30) Foreign Application Priority Data

Jun. 14, 2012 (JP) ..... 2012-134779

(51) Int. Cl.
*G03G 15/01* (2006.01)
*G03G 15/10* (2006.01)
*G03G 15/08* (2006.01)

(52) U.S. Cl.
CPC ..... *G03G 15/101* (2013.01); *G03G 15/0806* (2013.01)

(58) Field of Classification Search
CPC ..... G03G 15/10; G03G 15/104; G03G 15/11
USPC ..... 399/233
See application file for complete search history.

(56) References Cited

U.S. PATENT DOCUMENTS 4,989,048 A * 1/1991 Arai et al. ..... 399/44
2004/0131372 A1 7/2004 Fujita et al.
2007/0077094 A1 4/2007 Ueda et al.
2010/0124428 A1* 5/2010 Tabata et al. ..... 399/57
2012/0063812 A1* 3/2012 Ozerov ..... 399/237
2012/0237237 A1* 9/2012 Hirai ..... 399/57

FOREIGN PATENT DOCUMENTS

JP 04-333082 A 11/1992
JP 2000-231268 A 8/2000
JP 2001-183909 A 7/2001
JP 2004-145189 A 5/2004

(Continued)

OTHER PUBLICATIONS

Japanese Office Action (Notice of Grounds of Rejection) dated Jul. 8, 2014, issued by the Japanese Patent Office in corresponding Japanese Patent Application No. 2012-134779 and an English translation thereof. (7 pgs).

*Primary Examiner* — Walter Lindsay, Jr.
*Assistant Examiner* — Frederick Wenderoth
(74) *Attorney, Agent, or Firm* — Buchanan Ingersoll & Rooney PC

(57) ABSTRACT

A liquid development apparatus uses a developer to develop electrostatic latent images included in a plurality of image portion regions formed successively on an image carrier with an inter-image region being interposed. The liquid development apparatus includes a developer carrier and a control unit. Only a single developer carrier is provided so as to establish one-to-one relation with a single image carrier, it transports the developer to a development position opposed to the image carrier, and it develops the electrostatic latent image while it abuts to the image carrier. The control unit carries out prescribed control such that an amount of the developer supplied from the developer carrier to the inter-image region on the image carrier is reduced or set to zero.

9 Claims, 16 Drawing Sheets

(56) References Cited

FOREIGN PATENT DOCUMENTS

| | | | |
|---|---|---|---|
| JP | 2006-209020 | A | 8/2006 |
| JP | 2007-101611 | A | 4/2007 |
| JP | 2008-233397 | A | 10/2008 |
| JP | 2009-186748 | A | 8/2009 |

* cited by examiner

P1
Q1
P2
Q2
P3
AMOUNT OF TONER

PROPER AMOUNT
0
t1
t2
t1
t2
DISTANCE BETWEEN SHAFTS

DISTANT STATE
PRESSURE-CONTACT STATE
T0
Ta
Tb
Tc
Td
Te
Tf
Ta
Tb
Tc
Td
Te
Tf
TIME

LIQUID DEVELOPMENT APPARATUS AND WET-TYPE IMAGE FORMING APPARATUS

This application is based on Japanese Patent Application No. 2012-134779 filed with the Japan Patent Office on Jun. 14, 2012, the entire content of which is hereby incorporated by reference.

BACKGROUND OF THE INVENTION

1. Field of the Invention

The present invention relates to a liquid development apparatus and a wet-type image forming apparatus, and particularly to a liquid development apparatus for developing an electrostatic latent image formed on an image carrier with the use of a developer containing a carrier solution and toner and to a wet-type image forming apparatus including the liquid development apparatus.

2. Description of the Related Art

Japanese Laid-Open Patent Publication No. 2006-209020 discloses an invention relating to a liquid image forming apparatus. In this liquid image forming apparatus, a first contact and spacing mechanism is employed. The first contact and spacing mechanism moves a development roller away from a photoconductor drum. A liquid developer pool generated in a nip portion between the photoconductor drum and the development roller is cleaned by a cleaning apparatus. This document says that, according to this liquid image forming apparatus, contamination of peripheral apparatuses arranged under the photoconductor drum can be prevented.

Japanese Laid-Open Patent Publication No. 2009-186748 discloses an invention relating to a development apparatus. This development apparatus includes a developer carrier and a developer carrier abutment member. The developer carrier abutment member reduces a pressure of abutment to the developer carrier while an image is not formed. The document says that, according to this development apparatus, a thickness of a thin layer formed of a liquid developer can properly be controlled without being adversely affected by fluctuation in temperature.

Japanese Laid-Open Patent Publication No. 2001-183909 discloses an invention relating to a wet-type development apparatus. This wet-type development apparatus includes a development member, a developer supply portion for supplying a liquid developer to a circumferential surface of the development member, film thickness restriction means for restricting a film thickness of the liquid developer supplied to the development member to a development interval or smaller, and a development member spacing and contact mechanism for moving the development member located at a development position away from a latent image carrier so as to move the development member to a prescribed retracted position. The document says that, according to this wet-type development apparatus, when a liquid developer low in viscosity is used, adhesion of the liquid developer to a non-latent image portion of the latent image carrier can be prevented and a printing speed and image quality can be improved.

SUMMARY OF THE INVENTION

In a wet-type image forming apparatus, in a case where an electrostatic latent image formed on a photoconductor is developed with the use of toner, distortion of an image called uneven granularity (image unevenness) is likely to occur. Occurrence of this uneven granularity can be suppressed by filling an upstream side of a nip portion (a development position) with a carrier solution. As measures for filling the upstream side of the nip portion with the carrier solution, it is possible that a developer in an amount equal to or greater than a threshold value at which it can pass through the nip portion between the photoconductor and the developer carrier is transported to the nip portion and the carrier solution is reduced in the nip portion.

In a case where the carrier solution is reduced, the carrier solution is present as a liquid pool on the upstream side of the nip portion. As a development process is continuously performed, the liquid pool grows more than necessary. Then, such disadvantages as a non-uniform thickness of a developer layer formed on a developer carrier and contamination of peripheral apparatuses are more likely, and consequently satisfactory successive formation of images is difficult to achieve.

An object of the present invention is to provide a liquid development apparatus capable of suppressing growth of a liquid pool even in a case where a development process is continuously performed and a wet-type image forming apparatus including the liquid development apparatus.

A liquid development apparatus according to the present invention is a liquid development apparatus for developing by using a developer containing a carrier solution and toner, electrostatic latent images included in a plurality of image portion regions formed successively on an image carrier with an inter-image region being interposed, and the liquid development apparatus includes a developer carrier for transporting the developer to a development position opposed to the image carrier and developing the electrostatic latent image while it abuts to the image carrier, only one developer carrier being provided such that one-to-one relation with a single image carrier is established, and a control unit for carrying out prescribed control such that an amount of the developer supplied from the developer carrier to the inter-image region on the image carrier is reduced or set to zero.

Preferably, the liquid development apparatus according to the present invention further includes a first drive mechanism for varying a distance between the developer carrier and the image carrier, and the first drive mechanism controlled by the control unit pressure-contacts the developer carrier and the image carrier with each other with first pressure-contact force while the developer carrier is opposed to the image portion region and increases a distance between the developer carrier and the image carrier or moves the developer carrier and the image carrier away from each other such that pressure-contact force between the developer carrier and the image carrier is smaller than the first pressure-contact force at prescribed timing when the developer carrier is opposed to the inter-image region.

Preferably, the liquid development apparatus according to the present invention further includes a developer supply portion for supplying the developer to the developer carrier through a supply position, and the developer supply portion controlled by the control unit supplies a prescribed amount of the developer to the developer carrier while a first potentially opposing portion in a surface of the developer carrier, which will be opposed to the image portion region, is located at the supply position and supplies the developer in an amount smaller than the prescribed amount to the developer carrier or supplies no developer to the developer carrier at prescribed timing when a second potentially opposing portion in the surface of the developer carrier, which will be opposed to the inter-image region, is located at the supply position.

Preferably, the developer supply portion includes an abutment member for supplying the developer to the developer carrier while it abuts to the developer carrier, and the abutment member abuts to the developer carrier while the first potentially opposing portion of the developer carrier is located at the supply position and the abutment member moves away from the developer carrier at prescribed timing when the second potentially opposing portion of the developer carrier is located at the supply position.

Preferably, the control unit drives the developer supply portion while the first potentially opposing portion of the developer carrier is located at the supply position and the control unit stops drive of the developer supply portion at prescribed timing when the second potentially opposing portion of the developer carrier is located at the supply position.

A wet-type image forming apparatus according to one aspect of the present invention includes an image carrier, a transfer target member arranged to abut to the image carrier, a second drive mechanism for varying a distance between the image carrier and the transfer target member, and the liquid development apparatus according to the present invention, and the second drive mechanism pressure-contacts the image carrier and the transfer target member with each other with second pressure-contact force while the transfer target member is opposed to the image portion region and increases a distance between the image carrier and the transfer target member or moves the image carrier and the transfer target member away from each other such that pressure-contact force between the image carrier and the transfer target member is smaller than the second pressure-contact force at prescribed timing when the transfer target member is opposed to the inter-image region.

A wet-type image forming apparatus according to another aspect of the present invention includes an image carrier, a transfer target member arranged to abut to the image carrier, the liquid development apparatus according to the present invention, and a cleaning member arranged at a position upstream of a portion of abutment between the image carrier and the transfer target member and downstream of the development position, and the cleaning member moves away from the image carrier while the cleaning member is opposed to the image portion region and abuts to the image carrier at prescribed timing when the cleaning member is opposed to the inter-image region.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
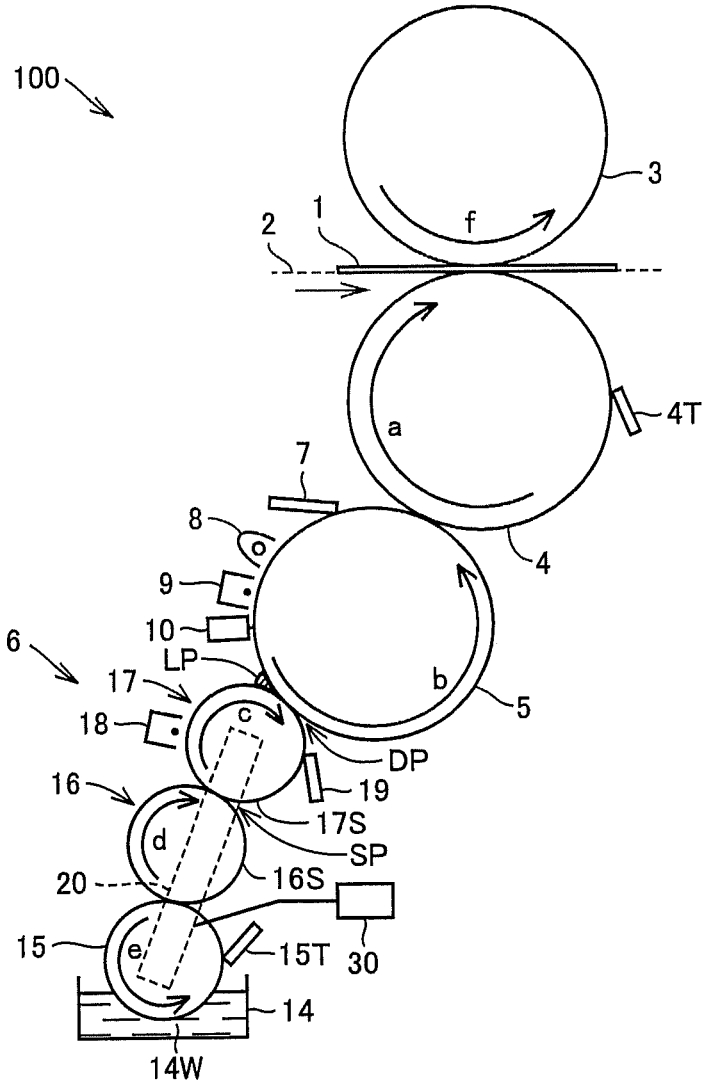
FIG. 1 is a diagram schematically showing a wet-type image forming apparatus in Embodiment 1.

Each embodiment based on the present invention will be described hereinafter with reference to the drawings. When the number, an amount or the like is mentioned in the description of each embodiment, the scope of the present invention is not necessarily limited to the number, the amount or the like, unless otherwise specified. In the description of each embodiment, the same or corresponding elements have the same reference characters allotted and redundant description may not be repeated.

Embodiment 1

Wet-Type Image Forming Apparatus 100

FIG. 1 is a diagram schematically showing a wet-type image forming apparatus 100 in the present embodiment. As shown in FIG. 1, wet-type image forming apparatus 100 includes a paper transportation path 2, a transfer roller 3, an intermediate transfer element 4 (a transfer target member), a photoconductor 5 (an image carrier), a liquid development apparatus 6, a cleaning blade 7, a diselectrifier 8, a charger 9, an exposure apparatus 10, and a cleaning blade 4T.

Paper transportation path 2 is formed between transfer roller 3 and intermediate transfer element 4. Printing paper 1 is sent from a not-shown paper feed apparatus to paper transportation path 2. One photoconductor 5 is provided to abut to intermediate transfer element 4 rotating in a direction shown with an arrow a. In wet-type image forming apparatus 100, only a single liquid development apparatus 6 (a development roller 17) is provided to establish one-to-one relation with the single photoconductor 5.

Photoconductor 5 is in a shape of a drum and rotates in a direction shown with an arrow b. Cleaning blade 7, diselectrifier 8, charger 9, exposure apparatus 10, liquid development apparatus 6, and intermediate transfer element 4 are successively arranged around photoconductor 5 along a direction of rotation of photoconductor 5. A developer or the like which remains on photoconductor 5 is removed from photoconductor 5 by cleaning blade 7. A latent image which remains on photoconductor 5 is erased by diselectrifier 8.

A surface of photoconductor 5 is evenly charged by charger 9. Exposure apparatus 10 irradiates the surface of photoconductor 5 with light based on prescribed image information. An electrostatic latent image based on the prescribed image information is formed on the surface of photoconductor 5. As photoconductor 5 rotates, the electrostatic latent image is transported to a development position DP. Liquid development apparatus 6 transports the developer (a liquid developer containing a carrier solution and toner) to development position DP opposed to photoconductor 5. Liquid development apparatus 6 develops the electrostatic latent image formed on photoconductor 5 with the use of a developer (a development process). As the electrostatic latent image is developed, a toner image is formed on photoconductor 5.

Intermediate transfer element 4 is arranged to abut to photoconductor 5. Electric field is formed between intermediate transfer element 4 and photoconductor 5 by a not-shown voltage application apparatus. As a result of action of this electric field, the toner image on photoconductor 5 is transferred onto intermediate transfer element 4 (a primary transfer process). The toner image or the like which remained on photoconductor 5 after transfer is removed from photoconductor 5 by cleaning blade 7.

Transfer roller 3 is arranged to be opposed to intermediate transfer element 4 and rotates in a direction shown with an arrow f. Printing paper 1 sent to paper transportation path 2 passes between transfer roller 3 and intermediate transfer element 4. Electric field is formed between intermediate transfer element 4 and transfer roller 3 by a not-shown voltage application apparatus. As a result of action of this electric field, the toner image on intermediate transfer element 4 is transferred onto printing paper 1 (a secondary transfer process). The toner image or the like which remained on intermediate transfer element 4 after transfer is removed from intermediate transfer element 4 by cleaning blade 4T.

The toner image transferred onto printing paper 1 is heated and pressurized by a not-shown fixing apparatus and fixed onto printing paper 1 as an image. Printing paper 1 having the image formed on its surface is ejected from a paper ejection apparatus (not shown) as output. Transfer roller 3, intermediate transfer element 4, and photoconductor 5 in the present embodiment are each formed from a member like a roller, however, these may be formed from a member like a belt.

(Liquid Development Apparatus 6)

Liquid development apparatus 6 in the present embodiment includes a developer bath 14 for storing a developing solution 14W, a draw-up roller 15, a doctor blade 15T, a smoothing member 16, a development roller 17 (a developer carrier), a charging apparatus 18, a cleaning blade 19, a drive mechanism 20 (a first drive mechanism), and a control unit 30. Developing solution 14W is mainly composed of an insulating liquid which is a carrier solution, toner for developing an electrostatic latent image, and a dispersant for dispersing toner.

For the sake of convenience of illustration, drive mechanism 20 is schematically shown with a dotted line in FIG. 1. Details of drive mechanism 20 will be described later with reference to FIGS. 2 and 3. Draw-up roller 15, smoothing member 16, and development roller 17 in the present embodiment are each formed from a member like a roller, however, these may be formed from a member like a belt.

Developer bath 14 is replenished with developing solution 14W from a not-shown developer replenishment apparatus. Draw-up roller 15 is formed, for example, from an anilox roller. Draw-up roller 15 may be formed from a roller having a smooth surface and made of a metal or from a roller provided with rubber or a resin layer on its surface. A part of draw-up roller 15 is immersed in developing solution 14W. As draw-up roller 15 rotates in a direction shown with an arrow e, developing solution 14W is drawn up to a surface of draw-up roller 15. Doctor blade 15T scrapes off an excess of the developer drawn by draw-up roller 15.

Smoothing member 16 rotates in a direction shown with an arrow d and arranged to abut to draw-up roller 15. Smoothing member 16 is formed from a roller provided with rubber or a resin layer on its surface. Smoothing member 16 is desirably formed of an appropriate material in conformity with a material for draw-up roller 15. The developing solution carried on draw-up roller 15 is passed from draw-up roller 15 to a surface of smoothing member 16 at a portion of abutment (a position of pass) between draw-up roller 15 and smoothing member 16.

Development roller 17 rotates in a direction shown with an arrow c. Development roller 17 and smoothing member 16 in the present embodiment rotate such that a surface 17S of development roller 17 and a surface 16S of smoothing member 16 move in directions opposite to each other at a portion of abutment therebetween (a supply position SP) (counter rotation). A prescribed amount of developer is supplied from surface 16S of smoothing member 16 to surface 17S of development roller 17.

More specifically, the developer carried on surface 16S of smoothing member 16 is transported toward supply position SP owing to rotation of smoothing member 16. At supply position SP, while surface 16S of smoothing member 16 abuts to surface 17S of development roller 17, the developer is supplied from surface 16S of smoothing member 16 to surface 17S of development roller 17. Surface 17S of development roller 17 carries an appropriate amount of developer as a layer having a uniform thickness.

Charging apparatus 18 is arranged at a position upstream of the portion of abutment between development roller 17 and photoconductor 5 (development position DP) in a direction of rotation of development roller 17 (the direction shown with arrow c) and downstream of the portion of abutment between development roller 17 and smoothing member 16 (supply position SP) in the direction of rotation of development roller 17 (the direction shown with arrow c). Charging apparatus 18 charges the developer (a thin layer of the developer) held on development roller 17. The charged developer is transported toward development position DP where development roller 17 is opposed to photoconductor 5 owing to rotation of development roller 17.

Here, in a case where wet-type image forming apparatus 100 carries out continuous printing on each of a plurality of sheets of printing paper 1 (sheets) or continuous printing on some sheets of printing paper 1 (continuous forms), a liquid pool LP is formed as shown in FIG. 1. Liquid pool LP is formed in a case where the developer in an amount equal to or more than a threshold value at which it can pass through a nip portion (development position DP) between development roller 17 and photoconductor 5 is transported to this nip portion. When an electrostatic latent image is developed in this state, occurrence of image noise called uneven granularity can be suppressed.

On the other hand, when continuous printing is carried out, this liquid pool LP grows more than necessary, and such disadvantages as a non-uniform thickness of a thin layer formed on development roller 17 and contamination of peripheral apparatuses due to scattering of liquid pool LP are caused. Control unit 30 of wet-type image forming apparatus 100 carries out control as below for reducing an amount of liquid pool LP in order to suppress occurrence of such disadvantages.

(Drive Mechanism 20)

Figure 2:
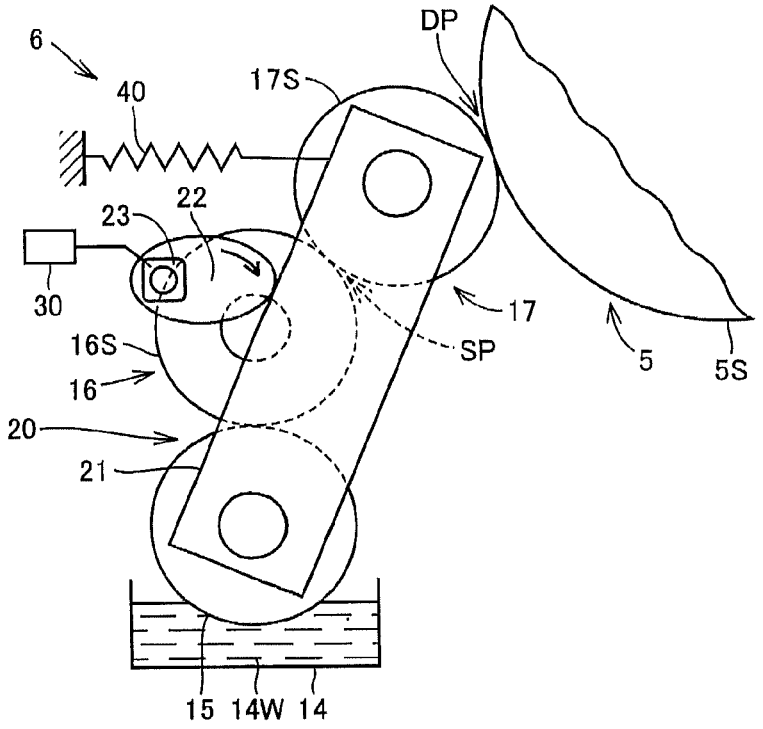
FIG. 2 is a first diagram showing a drive mechanism used in a liquid development apparatus in Embodiment 1 (a development roller being in pressure-contact with a photoconductor).

FIG. 2 is a diagram showing drive mechanism 20 used in liquid development apparatus 6 in the present embodiment. Drive mechanism 20 is controlled by control unit 30 and it pressure-contacts development roller 17 with photoconductor 5 or moves development roller 17 away from photoconductor 5 (development position DP) by varying a distance between development roller 17 and photoconductor 5. FIG. 2 shows a state that drive mechanism 20 pressure-contacts development roller 17 with photoconductor 5. Surface 17S of development roller 17 is located at development position DP.

Drive mechanism 20 in the present embodiment includes an arm 21, a cam 22, a drive motor 23, and a spring 40. An upper end portion of arm 21 supports a rotation shaft of development roller 17. Arm 21 pivots together with development roller 17 around a lower end portion of arm 21. Cam 22 has an oval shape and an edge of cam 22 abuts to arm 21. Cam 22 is pivoted by drive motor 23. Drive motor 23 is controlled by control unit 30.

Spring 40 provided in an upper portion of arm 21 applies prescribed tensile force to arm 21. Cam 22 biases arm 21 against this tensile force toward the right of the sheet surface and pressure-contacts development roller 17 with photoconductor 5 with prescribed pressure-contact force (first pressure-contact force). In the state shown in FIG. 2, developing solution 14W stored in developer bath 14 is supplied to development roller 17 via draw-up roller 15 and smoothing member 16.

The developer supplied to surface 17S of development roller 17 is transported to development position DP where development roller 17 is opposed to photoconductor 5, owing to rotation of development roller 17. When a prescribed control signal is input to control unit 30 in this state, control unit 30 drives drive motor 23 and causes cam 22 to pivot in a direction shown with an arrow in FIG. 2.

Figure 3:
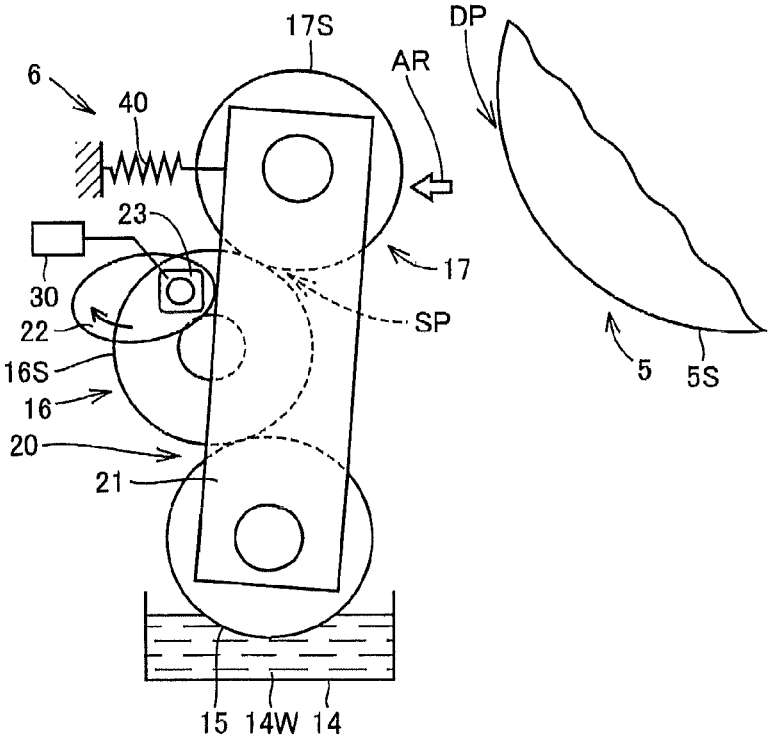
FIG. 3 is a second diagram showing the drive mechanism used in the liquid development apparatus in Embodiment 1 (the development roller being distant from the photoconductor).

Referring to FIG. 3, as cam 22 pivots, arm 21 pivots toward the left of the sheet surface upon receiving tensile force applied by spring 40 (see an arrow AR). Development roller 17 supported at an upper end of arm 21 moves in a direction shown with arrow AR. Development roller 17 moves away from photoconductor 5 (development position DP).

In a state that development roller 17 is distant from photoconductor 5 (development position DP), developing solution 14W stored in developer bath 14 is not supplied to photoconductor 5. As cam 22 further pivots, arm 21 pivots against tensile force applied by spring 40 toward the right of the sheet surface. Development roller 17 is pressure-contacted with photoconductor 5 with prescribed pressure-contact force (first pressure-contact force). Control unit 30 and drive mechanism 20 in the present embodiment make use of the operation as above, to thereby pressure-contact development roller 17 with photoconductor 5 or move development roller 17 away from photoconductor 5.

Figure 4:
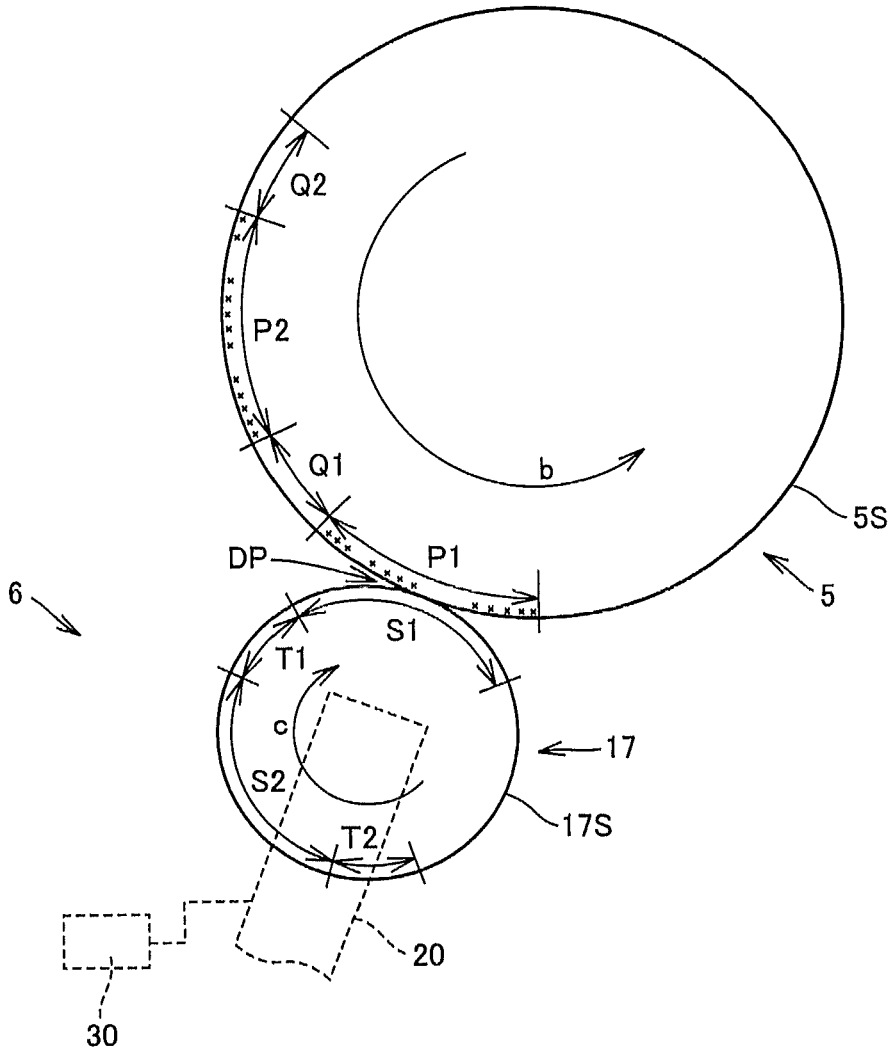
FIG. 4 is a first diagram for illustrating an operation for control of the drive mechanism by a control unit used in the liquid development apparatus in Embodiment 1 (a supply roller abutting to the development roller).

An operation for control unit 30 to control drive mechanism 20 will be described with reference to FIGS. 4 and 5. As shown in FIG. 4, when wet-type image forming apparatus 100 (see FIG. 1) in the present embodiment operates to successively form images on printing paper 1, an image portion region P1, an inter-image region Q1, an image portion region P2, and an inter-image region Q2 are successively formed on a surface 5S of photoconductor 5. In image portion region P1, P2, an electrostatic latent image based on a prescribed image signal is formed. Inter-image region Q1, Q2 is a region not serving for image formation on printing paper 1 (in other words, a region other than image portion region P1, P2).

For example, in a case where a plurality of sheets are employed as printing paper 1 on which printing is to be carried out, image portion region P1 corresponds to an image formed on one sheet of printing paper 1, and image portion region P2 corresponds to an image formed on a next one sheet of printing paper 1. Inter-image region Q1 is a portion corresponding to a region between printing paper 1 and the next sheet of printing paper 1, and it is a region where no image is formed. Inter-image region Q2 is a portion corresponding to a region between next printing paper 1 and second next printing paper 1, and it is a region where no image is formed.

In the present embodiment, image portion regions P1, P2 and inter-image regions Q1, Q2 are formed so as to adapt to two sheets. In a case where a large number of sheets are employed as printing paper 1 on which printing is to be carried out, image portion regions as many as the sheets are successively formed on surface 5S of photoconductor 5, and an inter-image region is formed between adjacent image portion regions.

In a case where continuous forms are employed as printing paper 1 on which printing is to be carried out, image portion region P1 corresponds to an image formed in a prescribed region located on an upstream side of the continuous forms, and image portion region P2 corresponds to an image formed in another prescribed region located on a downstream side of those continuous forms. Wet-type image forming apparatus 100 forms image portion regions successively on surface 5S of photoconductor 5 with an inter-image region being interposed, whether an image is formed successively on each of a plurality of sheets or images are formed successively on continuous forms.

Though an image portion region and an inter-image region are formed in a part of surface 5S of photoconductor 5 in FIG. 4, a width in a circumferential direction of the image portion region can arbitrarily be varied in conformity with a width of an image to be formed on printing paper 1. A width in a circumferential direction of an inter-image region can also arbitrarily be varied depending on a dimension of printing paper 1, specifications of the wet-type image forming apparatus, or the like. Therefore, positions of an image portion region and an inter-image region may be displaced over time toward the upstream or the downstream each time photoconductor 5 rotates.

As described above, development roller 17 and photoconductor 5 rotate such that surface 17S of development roller 17 is opposed to surface 5S of photoconductor 5. A part of surface 17S of development roller 17 (a first potentially opposing portion S1) is opposed to image portion region P1 in surface 5S of photoconductor 5. A width in a circumferential direction of first potentially opposing portion S1 corresponds to a width in the circumferential direction of image portion region P1. A part of surface 17S of development roller 17 (a second potentially opposing portion T1) is opposed (will be opposed) to inter-image region Q1 in surface 5S of photoconductor 5. A width in the circumferential direction of second potentially opposing portion T1 corresponds to a width in the circumferential direction of inter-image region Q1.

Similarly, a part of surface 17S of development roller 17 (a first potentially opposing portion S2) is opposed (will be opposed) to image portion region P2 in surface 5S of photoconductor 5. A width in the circumferential direction of first potentially opposing portion S2 corresponds to a width in the circumferential direction of image portion region P2. A part of surface 17S of development roller 17 (a second potentially opposing portion T2) is opposed (will be opposed) to inter-image region Q2 in surface 5S of photoconductor 5. A width in the circumferential direction of second potentially opposing portion T2 corresponds to a width in the circumferential direction of inter-image region Q2.

The developer carried on first potentially opposing portion S1 of development roller 17 is used for developing an electrostatic latent image to be formed in image portion region P1 of photoconductor 5. The developer carried on first potentially opposing portion S2 of development roller 17 is used for developing an electrostatic latent image to be formed in image portion region P2 of photoconductor 5.

On the other hand, even though the developer is carried on second potentially opposing portion T1 of development roller 17, the developer carried on second potentially opposing portion T1 will be opposed to inter-image region Q1, and hence it is not used for development of an electrostatic latent image in image portion region P1, P2. In other words, the developer carried on second potentially opposing portion T1 is not used for image formation on printing paper on which images are to successively be formed.

Similarly, even though the developer is carried on second potentially opposing portion T2 of development roller 17, the developer carried on second potentially opposing portion T2 will be opposed to inter-image region Q2, and hence it is not used for development of an electrostatic latent image in image portion region P1, P2. In other words, the developer carried on second potentially opposing portion T2 is not used for image formation on printing paper on which images are to successively be formed.

As described above, in wet-type image forming apparatus 100 (see FIG. 1) in the present embodiment, control unit 30 controls drive mechanism 20. When first potentially opposing portion S1, S2 of development roller 17 is opposed to image portion region P1, P2, drive mechanism 20 causes surface 17S of development roller 17 to be arranged at development position DP and causes surface 17S of development roller 17 to abut to (be pressure-contacted with) surface 5S of photoconductor 5. The developer is supplied from surface 17S of development roller 17 (first potentially opposing portion S1, S2) to image portion region P1, P2.

Figure 5:
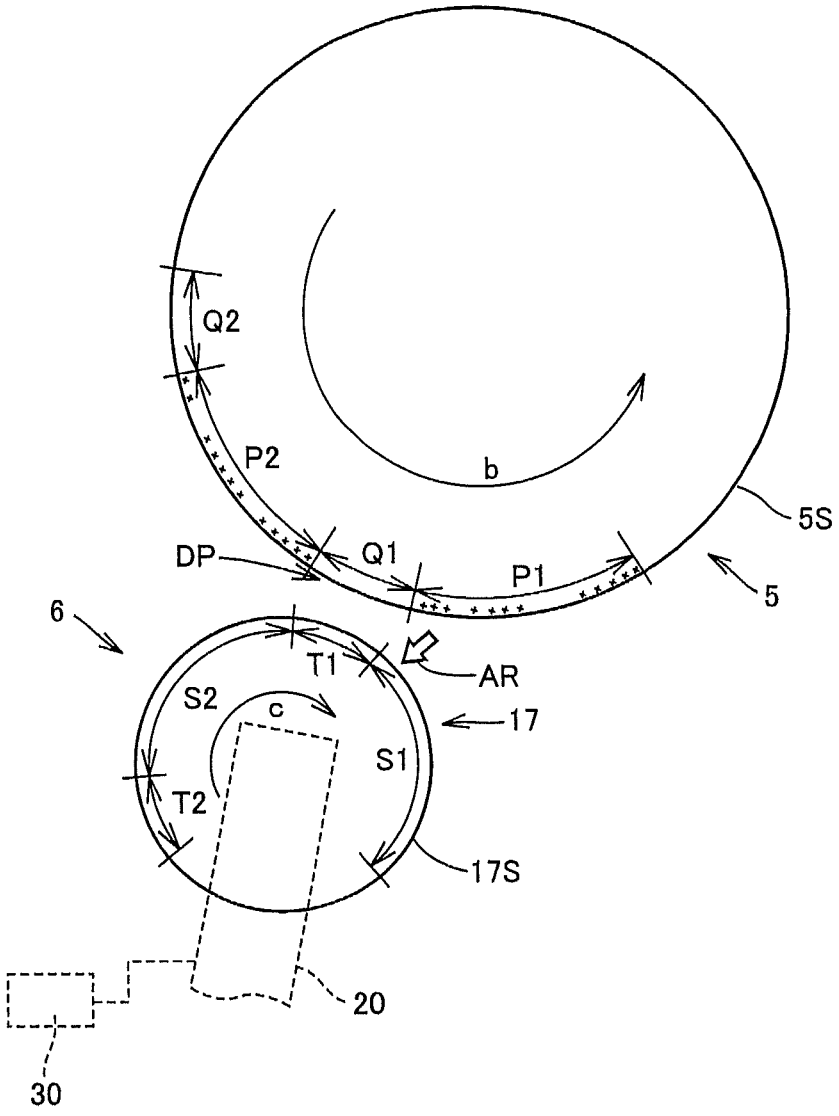
FIG. 5 is a second diagram for illustrating an operation for control of the drive mechanism by the control unit used in the liquid development apparatus in Embodiment 1 (the supply roller being distant from the development roller).

Referring to FIG. 5, on the other hand, drive mechanism 20 moves surface 17S of development roller 17 away from surface 5S of photoconductor 5 (development position DP) at prescribed timing when surface 17S of development roller 17 (second potentially opposing portion T1, T2) is opposed to inter-image region Q1, Q2 (in other words, at prescribed timing when inter-image region Q1, Q2 is located at development position DP). Owing to that operation, no developer is supplied from development roller 17 to inter-image region Q1, Q2.

As described above, inter-image region Q1, Q2 does not serve for image formation. Therefore, even though no developer is supplied to inter-image region Q1, Q2, wet-type image forming apparatus 100 (see FIG. 1) can use the developer supplied to image portion region P1, P2 to thereby successively form necessary images on printing paper 1.

Figure 6:
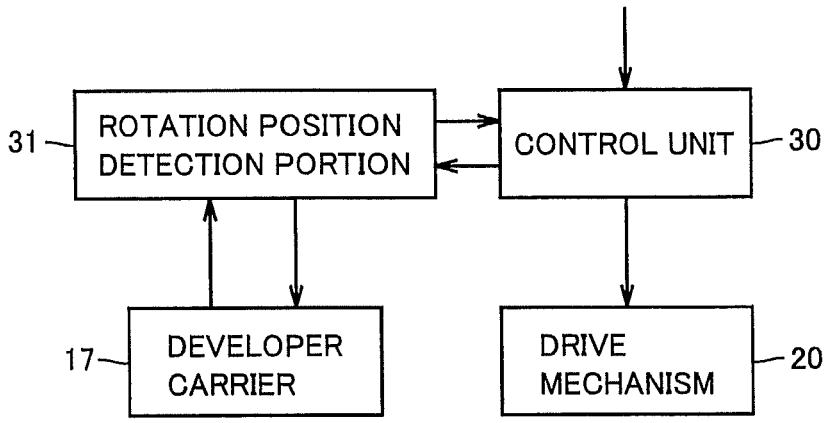
FIG. 6 is a diagram showing a control block in connection with the drive mechanism and the control unit used in the liquid development apparatus in Embodiment 1.

FIG. 6 is a diagram showing a control block in connection with drive mechanism 20 and control unit 30. Referring to FIG. 6, development roller 17 (developer carrier) is provided with a rotation position detection portion 31. Rotation position detection portion 31 reads a position of rotation (an angle of rotation) of development roller 17 and sends that information to control unit 30. Control unit 30 controls drive mechanism 20 based on the information received from rotation position detection portion 31.

Figure 7:
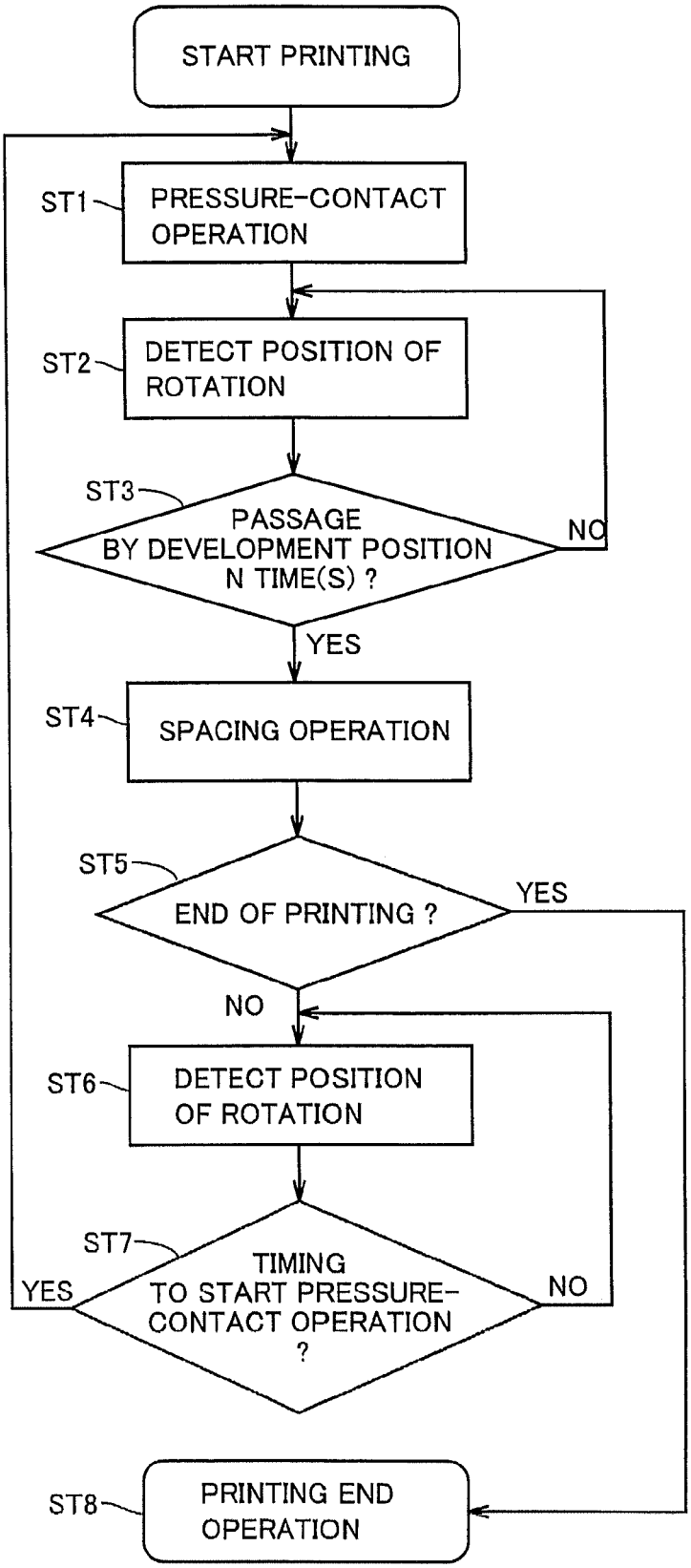
FIG. 7 is a flowchart showing an operation of the control unit or the like used in the liquid development apparatus in Embodiment 1.

A flowchart of an operation of control unit 30 for controlling drive mechanism 20 will be described in detail with reference to FIGS. 6 and 7. Initially, a signal indicating start of continuous printing is externally input to control unit 30. Control unit 30 controls drive of drive mechanism 20 and drive mechanism 20 pressure-contacts development roller 17 with photoconductor 5 (step ST1).

Control unit 30 uses rotation position detection portion 31 to detect a position of rotation of development roller 17 (step ST2). Control unit 30 counts the number of times of passage of the first potentially opposing portion (S1, S2) on development roller 17 by a portion of abutment to photoconductor 5 (development position DP), based on information on the position of rotation of development roller 17 obtained from rotation position detection portion 31.

A state of pressure-contact of development roller 17 with photoconductor 5 is maintained until the first potentially opposing portion on development roller 17 passes by the portion of abutment to photoconductor 5 (development position DP) N (N being any integer not smaller than 1) time(s) (NO in step ST3). N is a value determined in advance by setting. During this period, the developer is supplied to N image portion region(s) (P1, P2) and development in N image portion region(s) (P1, P2) is carried out. As the developer is supplied to the nip portion between development roller 17 and photoconductor 5 (development position DP), a liquid pool is formed between development roller 17 and photoconductor 5 and satisfactory development is carried out.

As described above with reference to FIGS. 4 and 5, for such an operation as causing development roller 17 to abut to image portion region P1, moving development roller 17 away from inter-image region Q1, causing development roller 17 to abut to image portion region P2, and moving development roller 17 away from inter-image region Q2, the value for N above is set to 1. The value for N can be set to any value as necessary. If the value for N is set to 1, development roller 17 will be moved away from the inter-image region each time the inter-image region passes. If the value for N is set to 2, development roller 17 is moved away from the inter-image region once every two times of passage of the inter-image region. Namely, development roller 17 should only be moved away from the inter-image region at prescribed timing when the inter-image region passes, such that growth of a liquid pool can be suppressed.

After the first potentially opposing portion (S1, S2) on development roller 17 has passed by development position DP N time(s) (YES in step ST3), control unit 30 drives drive mechanism 20 to thereby move development roller 17 away from photoconductor 5 at prescribed timing based on the value for N (step ST4). The distant state is continued from a time point at which the second potentially opposing portion (for example, T1) on development roller 17 starts to be located at a portion opposed to development position DP until that second potentially opposing portion (T1) substantially completes passage by the portion opposed to development position DP. During this period, no developer is supplied from development roller 17 to the inter-image region (Q1) on photoconductor 5 and no liquid pool grows between development roller 17 and photoconductor 5 either.

Figure 8:
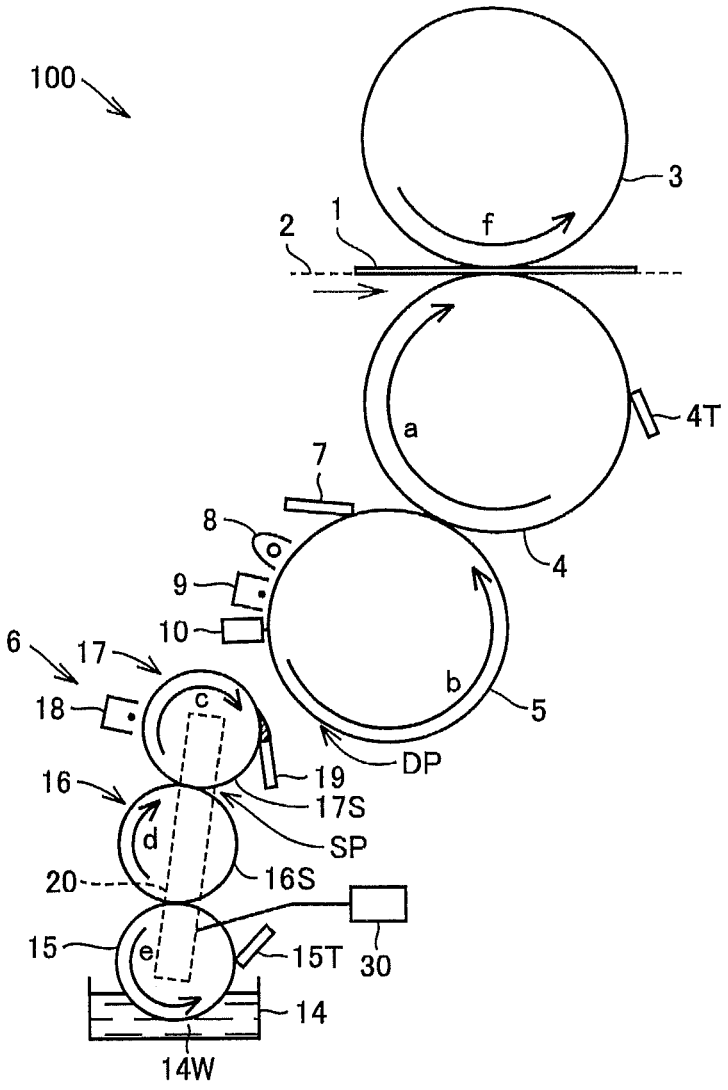
FIG. 8 is another diagram schematically showing the wet-type image forming apparatus in Embodiment 1 (the development roller being distant from the photoconductor).

As shown in FIG. 8, an excessive developer on development roller 17 is removed from the surface of development roller 17 by cleaning blade 19. An amount of the liquid pool which has been formed between development roller 17 and photoconductor 5 decreases.

Referring again to FIGS. 6 and 7, when no other first potentially opposing portion (S2) is present downstream of the second potentially opposing portion (T1) on development roller 17 after that second potentially opposing portion (T1) substantially completes passage by the portion opposed to development position DP (YES in step ST5), the continuous printing operation ends (step ST8). On the other hand, when another first potentially opposing portion (S2) is present downstream of the second potentially opposing portion (T1) after that second potentially opposing portion (T1) substantially completes passage by the portion opposed to development position DP (NO in step ST5), control unit 30 detects a position of rotation of development roller 17 (step ST6).

Control unit 30 detects a position of rotation of development roller 17 until another first potentially opposing portion (S2) on development roller 17 starts to reach the portion opposed to development position DP (NO in step ST7). Control unit 30 controls drive mechanism 20 when it determines that the first potentially opposing portion (S2) on development roller 17 has started to reach the portion opposed to development position DP (when it determines that the timing to start an operation for pressure-contact of development roller 17 with photoconductor 5 has come) (YES in step ST7), and drive mechanism 20 causes development roller 17 to abut to photoconductor 5 (step ST1). Control unit 30 repeats each step above until it can determine end of printing in step ST5 based on a signal input to control unit 30.

Figures 9A, 9B:
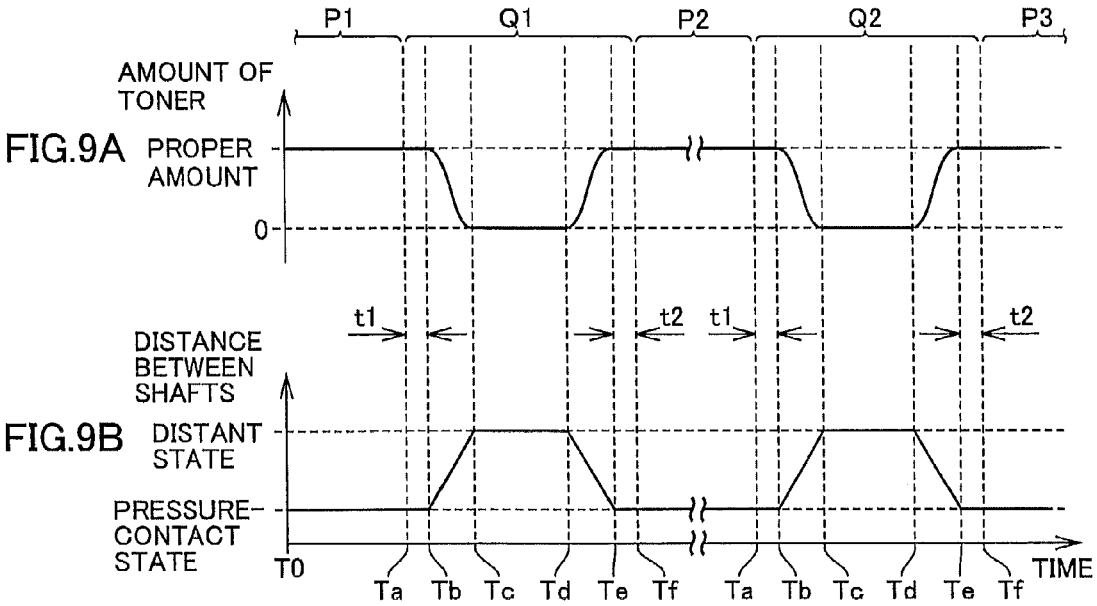
FIG. 9A is a diagram showing change over time in an amount of toner on the photoconductor located immediately downstream of a nip portion formed between the development roller and the photoconductor used in the liquid development apparatus in Embodiment 1.
FIG. 9B is a diagram showing change over time in a distance between a rotation shaft of the development roller and a rotation shaft of the photoconductor (a distance between shafts) used in the liquid development apparatus in Embodiment 1.

The operation as above will be described in further detail with reference to a timing chart in FIGS. 9 (A) and 9 (B). FIG. 9 (A) is a diagram showing change over time in an amount of toner on photoconductor 5 located immediately downstream of the nip portion formed between development roller 17 and photoconductor 5. FIG. 9 (B) is a diagram showing change over time in a distance between the rotation shaft of development roller 17 and the rotation shaft of photoconductor 5 (a distance between shafts). Here, by way of example, the value for N above is assumed as 1.

During a period from a time T0 to a time Ta, image portion region P1 of photoconductor 5 and surface 17S of development roller 17 are located at development position DP. Development roller 17 and photoconductor 5 are pressure-contacted with each other (a pressure-contact state). The developer is supplied from development roller 17 to photoconductor 5, and a proper amount of toner is supplied to an electrostatic latent image formed on surface 5S of photoconductor 5.

At time Ta, image portion region P1 of photoconductor 5 and the most downstream portion of first potentially opposing portion S1 of development roller 17 are located at development position DP. During a period from time Ta to a time Tb, inter-image region Q1 of photoconductor 5 is located at development position DP. Here, in moving development roller 17 away from photoconductor 5, an amount of supply of the developer from development roller 17 to photoconductor 5 tends to vary over time and an amount of supply may be different for each spacing operation.

Therefore, the spacing operation is desirably performed not simultaneously with passage of the most downstream portion of image portion region P1 (a boundary portion between image portion region P1 and inter-image region Q1) by development position DP (in other words, not at time Ta) but at time Tb which is later by a time period t1 than passage of the most downstream portion of image portion region P1 (in other words, the most downstream portion of first potentially opposing portion S1 on development roller 17) by development position DP. During this period, the most downstream portion of image portion region P1 (the most downstream portion of first potentially opposing portion S1) further moves from development position DP, for example, by approximately 5 mm.

The spacing operation started at time Tb is completed at a time Tc. During a period from time Tb to time Tc, a distance between the shafts gradually becomes greater and an amount of toner or an amount of the carrier solution on photoconductor 5 which immediately follows (is on the downstream side of) the nip portion (development position DP) decreases.

During a period from time Tc to a time Td, no developer is supplied from development roller 17 to photoconductor 5. No liquid pool grows either between development roller 17 and photoconductor 5. At time Td, drive mechanism 20 is driven and development roller 17 starts to come closer to photoconductor 5. During a period from time Td to a time Te, a distance between the shafts gradually becomes smaller and an amount of developer (an amount of carrier solution) on photoconductor 5 which immediately follows (is on the downstream side of) the nip portion (development position DP) gradually increases.

Here, at a time Tf, the most downstream portion of second potentially opposing portion T1 of development roller 17 is located at the portion opposed to development position DP. At the time point immediately after completion of a pressure-contact operation of development roller 17 with photoconductor 5, an amount of supply of the developer from development roller 17 to photoconductor 5 tends to vary over time and an amount of supply tends to be different for each abutment operation (pressure-contact operation).

Therefore, the pressure-contact operation does not complete simultaneously with passage of the most downstream portion of second potentially opposing portion T1 (a portion of boundary between second potentially opposing portion T1 and first potentially opposing portion S2) by the portion opposed to development position DP (in other words, the pressure-contact operation is not completed at time Tf) but the pressure-contact operation is desirably started from time Td such that the pressure-contact operation is completed at the time point (time Te) earlier by a time period t2 than passage of the most downstream portion of second potentially opposing portion T1 by the position opposed to development position DP. In this case, at the time point when the most upstream portion of image portion region P2 (the most upstream portion of first potentially opposing portion S2) is located at a position approximately 5 mm before development position DP (at time Te), the pressure-contact operation is completed.

During a period from time Tf to subsequent time Ta, image portion region P2 of photoconductor 5 and first potentially opposing portion S2 of development roller 17 are located at development position DP. Development roller 17 and photoconductor 5 are pressure-contacted with each other (the pressure-contact state). The developer is supplied to an electrostatic latent image on photoconductor 5 from development roller 17 and a toner image containing a proper amount of toner is formed on surface 5S of photoconductor 5. The operation as above is repeated also for inter-image region Q2 and an image portion region P3.

As described above, in wet-type image forming apparatus 100 in the present embodiment, while surface 17S of development roller 17 is opposed to image portion region P1, P2, surface 17S of development roller 17 is arranged at development position DP and pressure-contacted with photoconductor 5 and the developer is supplied from development roller 17 to the electrostatic latent image in image portion region P1, P2.

On the other hand, at prescribed timing when surface 17S of development roller 17 is opposed to inter-image region Q1, Q2 (in other words, at prescribed timing when inter-image region Q1, Q2 is located at development position DP), surface 17S of development roller 17 is moved away from surface 5S of photoconductor 5 (development position DP). As described above, inter-image region Q1, Q2 on photoconductor 5 does not serve for image formation. Even though the developer is not supplied to inter-image region Q1, Q2, wet-type image forming apparatus 100 can successively form necessary images on printing paper 1 with the use of the developer supplied to image portion region P1, P2.

Therefore, even when a development process is continuously performed, wet-type image forming apparatus 100 can form a proper amount of liquid pool in supplying the developer to image portion region P1, P2 and suppress occurrence of uneven granularity. On the other hand, as an amount of supply of the developer to inter-image region Q1, Q2 is decreased, formation of a liquid pool more than necessary is suppressed. Wet-type image forming apparatus 100 can obtain a good image in a stable manner even during continuous image formation.

As described above, in wet-type image forming apparatus 100 in the present embodiment, when development roller 17 is opposed to image portion region P1, P2, development roller 17 and photoconductor 5 are pressure-contacted with each other with prescribed pressure-contact force (first pressure-contact force). When development roller 17 is opposed to inter-image region Q1, Q2, development roller 17 is completely moved away from photoconductor 5.

In contrast, at prescribed timing when development roller 17 is opposed to inter-image region Q1, Q2, a distance between development roller 17 and photoconductor 5 may be increased such that pressure-contact force between development roller 17 and photoconductor 5 is smaller than the pressure-contact force above (first pressure-contact force). According to the feature as well, an amount of a developing solution which passes by development roller 17 and photoconductor 5 increases and growth of a liquid pool can be suppressed. According to the feature as well, a stable and good image can be obtained during continuous image formation.

An operation for decreasing pressure-contact force is desirably adjusted by a position of rotation of cam 22. In a case where a shaft of development roller 17 is constructed to be movable, cam 22 may directly be pressure-contacted with the shaft of development roller 17. In this case, since arm 21 is not employed, the number of parts can be reduced. Cam 22 may be connected to a motor (not shown) for driving development roller 17 with a gear being interposed. In this case, cam 22 may be constructed to make one turn each time one image is formed. In this case, since drive motor 23 is not employed, the number of parts can be reduced.

Embodiment 2

Figure 10:
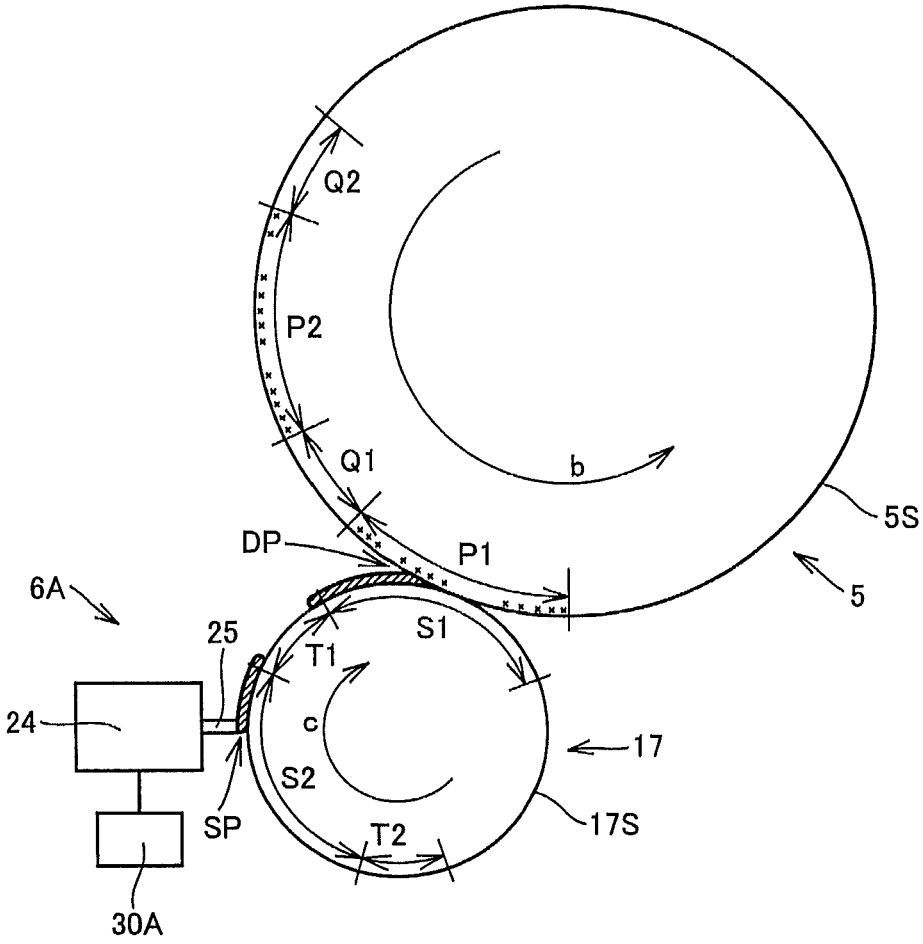
FIG. 10 is a diagram showing a liquid development apparatus in Embodiment 2.

A liquid development apparatus 6A in the present embodiment will be described with reference to FIG. 10. Liquid development apparatus 6A includes development roller 17, a developer application mechanism 24 (a developer supply portion), and a control unit 30A. Developer application mechanism 24 is formed, for example, from a die coater. A tip end nozzle 25 of developer application mechanism 24 and development roller 17 are opposed to each other at supply position SP. Developer application mechanism 24 is controlled by control unit 30A and supplies the developer to development roller 17 via supply position SP.

Developer application mechanism 24 supplies a prescribed amount of developer to surface 17S of development roller 17 when first potentially opposing portion S1, S2 in surface 17S of development roller 17, which will be opposed to image portion region P1, P2, is located at supply position SP. On the other hand, developer application mechanism 24 supplies the developer in an amount smaller than the prescribed amount above to surface 17S of development roller 17 or does not supply the developer to surface 17S of development roller 17 at prescribed timing when second potentially opposing portion T1, T2 in surface 17S of development roller 17, which will be opposed to inter-image region Q1, Q2, is located at supply position SP.

Control unit 30A may be configured such that it drives developer application mechanism 24 while first potentially opposing portion S1, S2 of development roller 17 is located at supply position SP and it stops driving developer application mechanism 24 at prescribed timing when second potentially opposing portion T1, T2 of development roller 17 is located at supply position SP.

According to the feature as well, in a case where the development process is continuously performed, in supplying the developer to image portion region P1, P2 from development roller 17, a proper amount of liquid pool can be formed and occurrence of uneven granularity can be suppressed. An amount of supply of the developer to inter-image region Q1, Q2 is decreased and formation of a liquid pool more than necessary is suppressed. Therefore, in a case where liquid development apparatus 6A is employed as well, a good image can be obtained in a stable manner during continuous image formation.

Embodiment 3

A liquid development apparatus 6B in the present embodiment will be described with reference to FIGS. 11 and 12. Liquid development apparatus 6B includes a developer bath (not shown), draw-up roller 15, smoothing member 16 (abutment member), development roller 17, a drive mechanism 20B, and a control unit 30B. Drive mechanism 20B causes smoothing member 16 to abut to development roller 17 or moves smoothing member 16 away from development roller 17.

Figure 11:
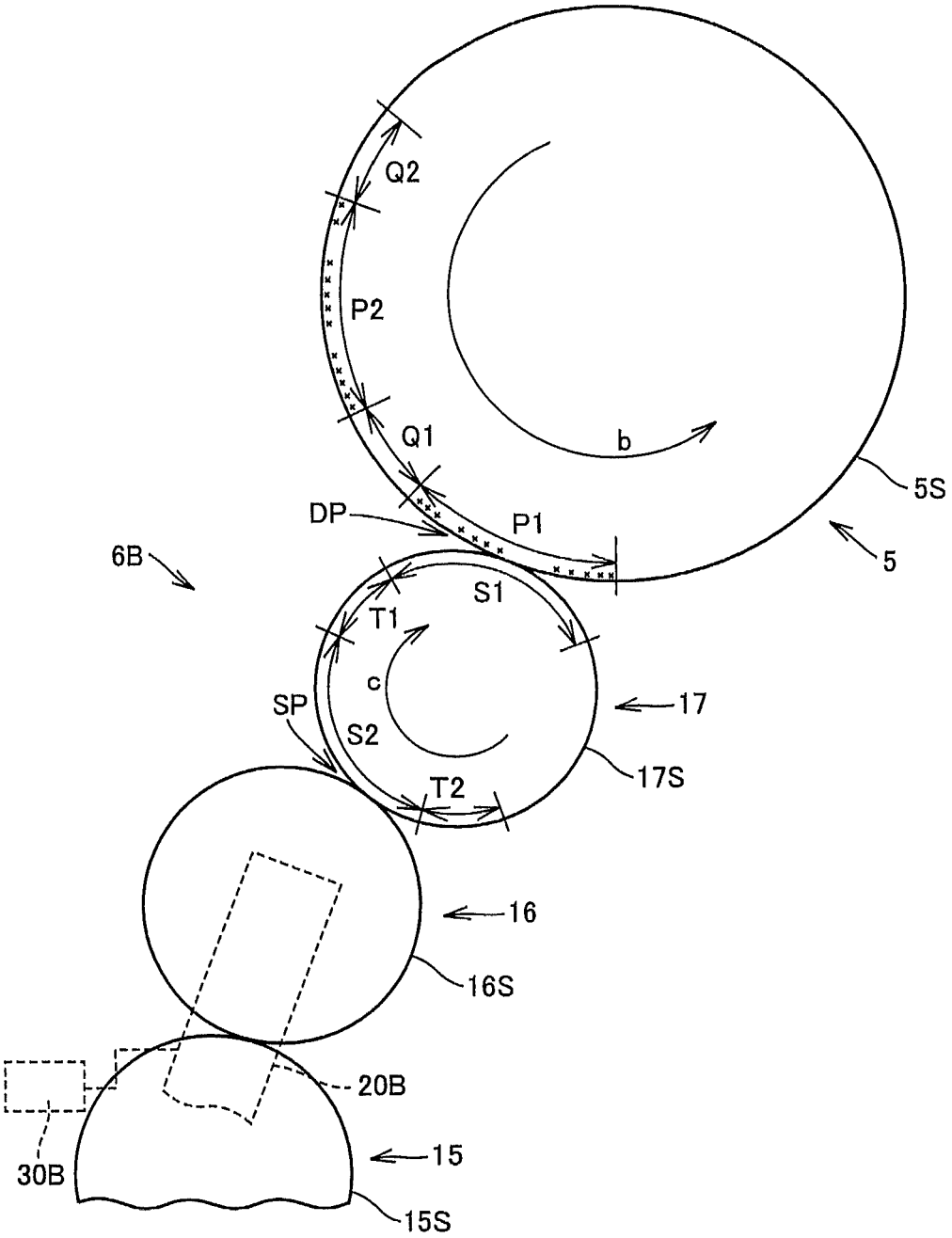
FIG. 11 is a first diagram showing a liquid development apparatus in Embodiment 3 (a smoothing member abutting to a development roller).

FIG. 11 illustrates a state that drive mechanism 20B causes smoothing member 16 to abut to development roller 17. Surface 16S of smoothing member 16 is located at supply position SP. In the state shown in FIG. 11, the developing solution stored in the developer bath is supplied to development roller 17 via draw-up roller 15 and smoothing member 16.

The developer is transported toward development position DP where development roller 17 is opposed to photoconductor 5, owing to rotation of development roller 17. When a prescribed control signal is input to control unit 30B in this state, control unit 30B drives drive mechanism 20B and drive mechanism 20B moves smoothing member 16 away from development roller 17.

Figure 12:
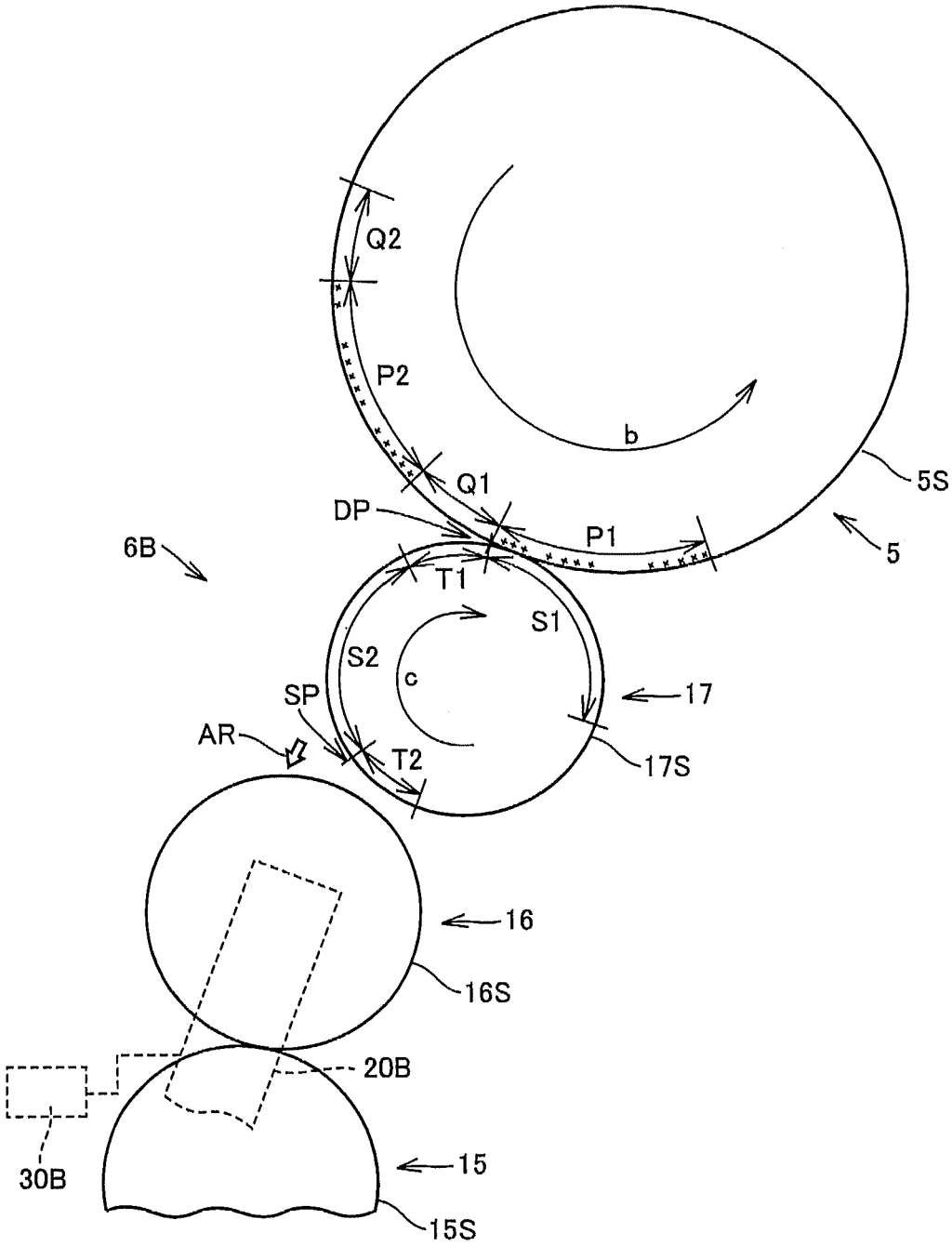
FIG. 12 is a second diagram showing the liquid development apparatus in Embodiment 3 (the smoothing member being distant from the development roller).

As shown in FIG. 12, smoothing member 16 is moved away from development roller 17 (supply position SP). While smoothing member 16 is distant from development roller 17

(supply position SP), the developing solution stored in the developer bath is not supplied to development roller 17.

Drive mechanism 20B controlled by control unit 30B causes surface 16S of smoothing member 16 to be arranged at supply position SP while surface 16S of smoothing member 16 is opposed to first potentially opposing portion S1, S2 of development roller 17 and causes surface 16S of smoothing member 16 to abut to (pressure-contact with) surface 17S of development roller 17. The developer is supplied from smoothing member 16 to first potentially opposing portion S1, S2.

On the other hand, drive mechanism 20B controlled by control unit 30B moves surface 16S of smoothing member 16 away from surface 17S of development roller 17 (supply position SP) at prescribed timing when surface 16S of smoothing member 16 is opposed to second potentially opposing portion T1, T2 (in other words, at prescribed timing when second potentially opposing portion T1, T2 is located at supply position SP). Owing to the operation, no developer is supplied from smoothing member 16 to second potentially opposing portion T1, T2. Inter-image region Q1, Q2 which will be opposed to second potentially opposing portion T1, T2 does not serve for image formation. Therefore, even though the developer is not supplied to second potentially opposing portion T1, T2, the developer supplied to first potentially opposing portion S1, S2 can be used to successively form necessary images on the printing paper.

According to the feature as well, in a case where the development process is continuously performed, in supplying the developer from development roller 17 to image portion region P1, P2, a proper amount of liquid pool can be formed and occurrence of uneven granularity can be suppressed. An amount of supply of the developer to inter-image region Q1, Q2 is decreased and formation of a liquid pool more than necessary is suppressed. Therefore, in a case where liquid development apparatus 6B is employed as well, a good image can be obtained in a stable manner during continuous image formation.

Embodiment 4

Figure 13:
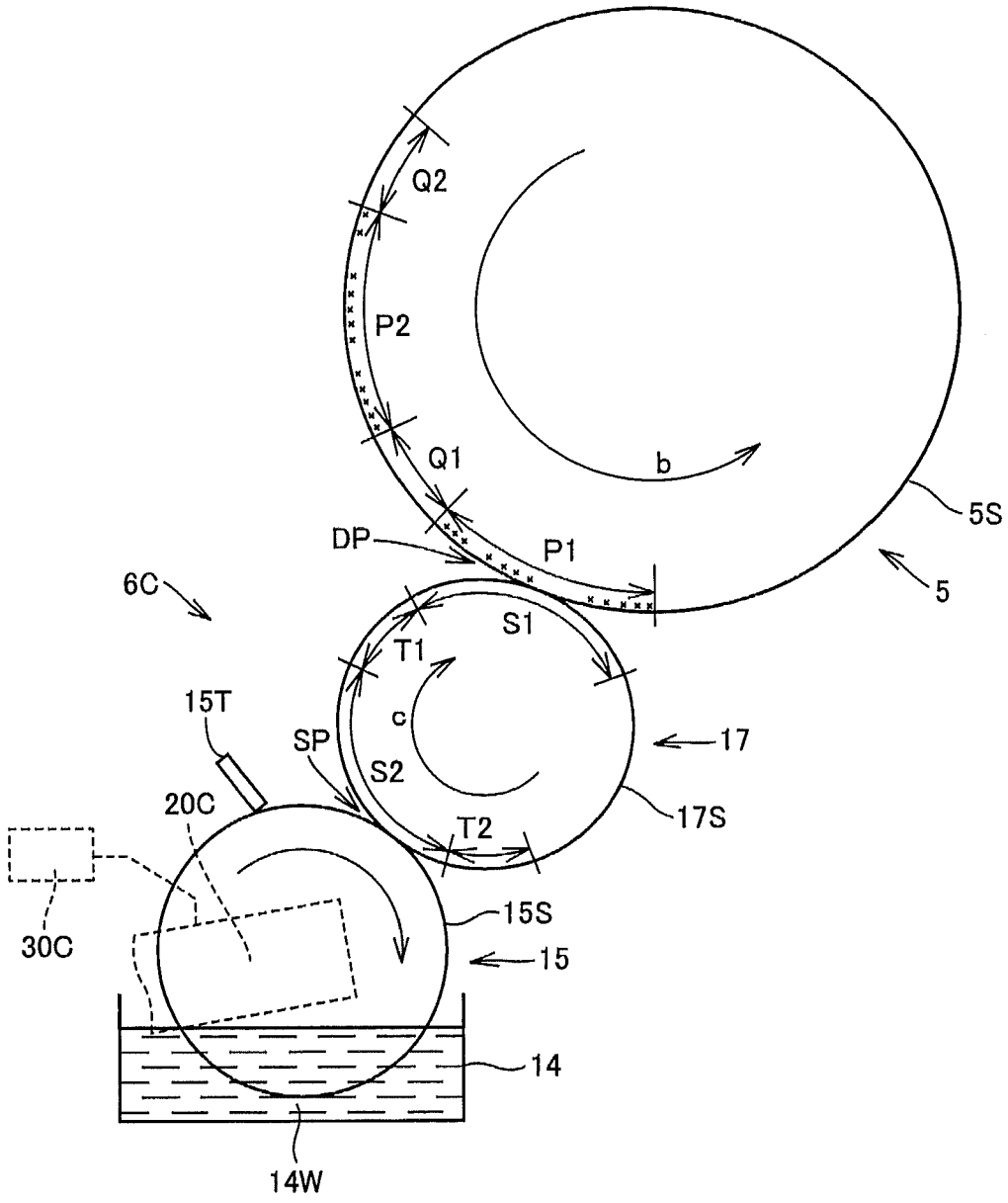
FIG. 13 is a diagram showing a liquid development apparatus in Embodiment 4.

A liquid development apparatus 6C in the present embodiment will be described with reference to FIG. 13. Liquid development apparatus 6C does not include a member corresponding to smoothing member 16 of liquid development apparatus 6 (see FIG. 1 and the like) in Embodiment 1 described above.

Liquid development apparatus 6C includes developer bath 14, draw-up roller 15 (abutment member), doctor blade 15T, a drive mechanism 20C, and a control unit 30C. Draw-up roller 15 in the present embodiment rotates in what is called a counter direction with respect to development roller 17. Drive mechanism 20C varies a distance between draw-up roller 15 and development roller 17, so as to cause draw-up roller 15 to abut to development roller 17 and move draw-up roller 15 away from development roller 17.

Drive mechanism 20C controlled by control unit 30C causes draw-up roller 15 to abut to development roller 17 while first potentially opposing portion S1, S2 in surface 17S of development roller 17, which will be opposed to image portion region P1, P2, is located at supply position SP. A prescribed amount of developer is supplied from draw-up roller 15 to development roller 17.

On the other hand, drive mechanism 20C controlled by control unit 30C moves draw-up roller 15 away from development roller 17 or decreases pressure-contact force of draw-up roller 15 against development roller 17 such that the developer in an amount smaller than the prescribed amount above is supplied to surface 17S of development roller 17 at prescribed timing when second potentially opposing portion T1, T2 in surface 17S of development roller 17, which will be opposed to inter-image region Q1, Q2, is located at supply position SP.

According to the feature as well, in a case where the development process is continuously performed, in supplying the developer from development roller 17 to image portion region P1, P2, a proper amount of liquid pool can be formed and occurrence of uneven granularity can be suppressed. An amount of supply of the developer to inter-image region Q1, Q2 is decreased and formation of a liquid pool more than necessary is suppressed. Therefore, in a case where liquid development apparatus 6C is employed as well, a good image can be obtained in a stable manner during continuous image formation.

In liquid development apparatus 6C, draw-up roller 15 may rotate in what is called a with direction with respect to development roller 17. In this case, drive mechanism 20C controlled by control unit 30C moves draw-up roller 15 away from development roller 17 such that the developer in an amount smaller than the prescribed amount above is supplied to surface 17S of development roller 17 at prescribed timing when second potentially opposing portion T1, T2 in surface 17S of development roller 17, which will be opposed to inter-image region Q1, Q2, is located at supply position SP. According to the feature as well, an effect the same as above can be obtained.

Embodiment 5

Figure 14:
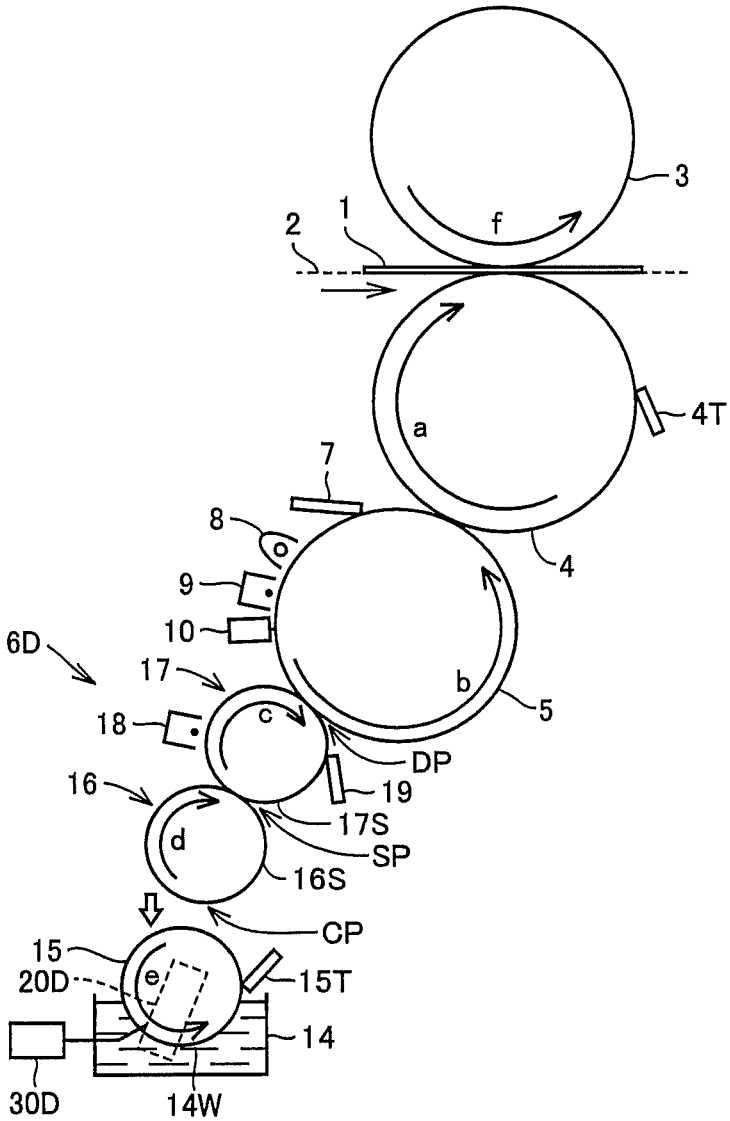
FIG. 14 is a diagram showing a liquid development apparatus in Embodiment 5.

A liquid development apparatus 6D in the present embodiment will be described with reference to FIG. 14. A drive mechanism 20D of liquid development apparatus 6D is controlled by a control unit 30D, and it causes draw-up roller 15 to abut to smoothing member 16 (developer supply portion) or moves draw-up roller 15 away from smoothing member 16.

In liquid development apparatus 6D, a pressure-contact operation or a spacing operation performed between development roller 17 and smoothing member 16 in Embodiment 4 described above is performed between smoothing member 16 and draw-up roller 15.

Drive mechanism 20D controlled by control unit 30D causes draw-up roller 15 to abut to smoothing member 16 while a portion in surface 16S of smoothing member 16, which will be opposed to the first potentially opposing portion (see S1, S2 on development roller 17 in FIG. 13), is located at a position of pass CP. A prescribed amount of developer is supplied from draw-up roller 15 to smoothing member 16.

On the other hand, drive mechanism 20D controlled by control unit 30D moves draw-up roller 15 away from smoothing member 16 such that the developer in an amount smaller than the prescribed amount above is supplied to surface 16S of smoothing member 16 at prescribed timing when a portion in surface 16S of smoothing member 16, which will be opposed to the second potentially opposing portion (see T1, T2 on development roller 17 in FIG. 13), is located at position of pass CP.

According to the feature as well, in a case where the development process is continuously performed, in supplying the developer from development roller 17 to image portion region P1, P2, a proper amount of liquid pool can be formed and occurrence of uneven granularity can be suppressed. An amount of supply of the developer to inter-image region Q1, Q2 is decreased and formation of a liquid pool more than necessary is suppressed. Therefore, in a case where liquid development apparatus 6D is employed as well, a good image can be obtained in a stable manner during continuous image formation.

Embodiment 6

Figure 15:
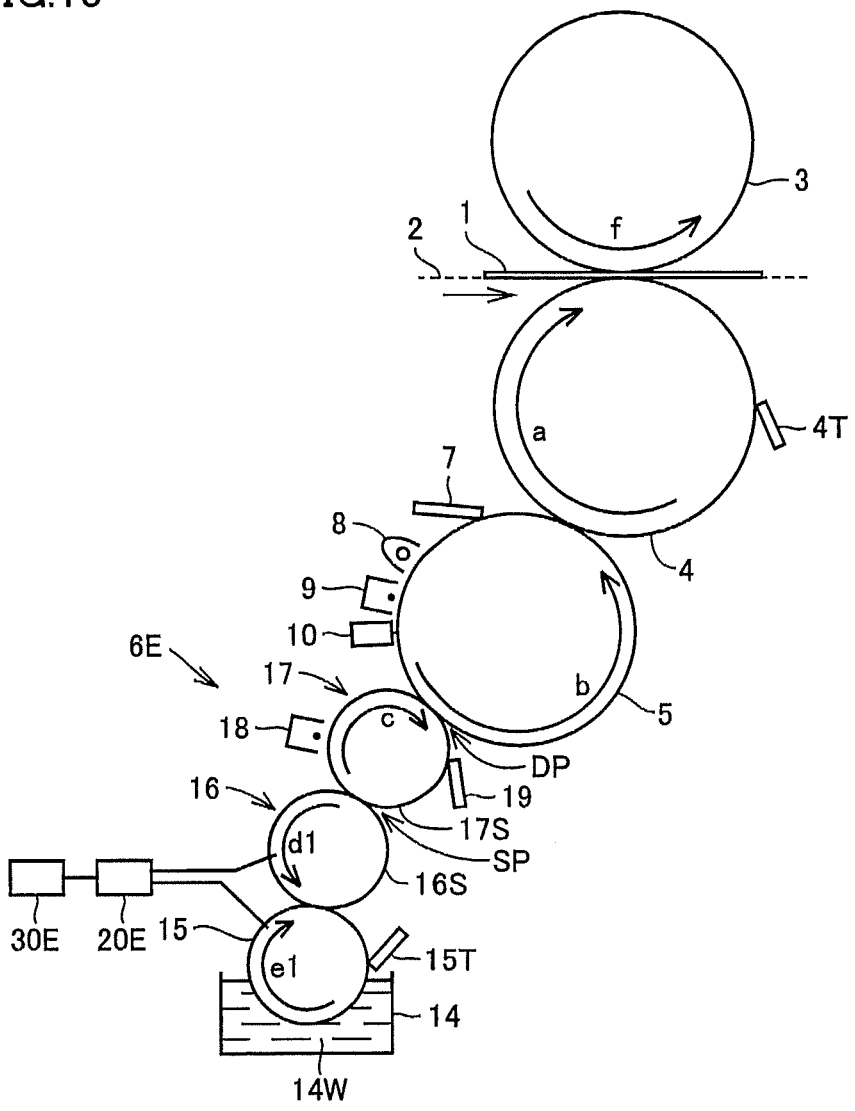
FIG. 15 is a diagram showing a liquid development apparatus in Embodiment 6.

A liquid development apparatus 6E in the present embodiment will be described with reference to FIG. 15. In liquid development apparatus 6E, draw-up roller 15 and smoothing member 16 function as the developer supply portion and they are driven by a control unit 30E and a drive mechanism 20E.

Drive mechanism 20E controlled by control unit 30E drives draw-up roller 15 and smoothing member 16 while the first potentially opposing portion (S1, S2) in surface 17S of development roller 17, which will be opposed to the image portion region (P1, P2), is located at supply position SP. Smoothing member 16 rotates in a counter direction with respect to development roller 17, and draw-up roller 15 rotates in a with direction with respect to smoothing member 16. A prescribed amount of developer is supplied from draw-up roller 15 to development roller 17 via smoothing member 16.

On the other hand, drive mechanism 20E controlled by control unit 30E stops driving draw-up roller 15 and smoothing member 16 such that the developer in an amount smaller than the prescribed amount above is supplied to surface 17S of development roller 17 at prescribed timing when the second potentially opposing portion (T1, T2) in surface 17S of development roller 17, which will be opposed to the inter-image region (Q1, Q2), is located at supply position SP. As shown in FIG. 15, smoothing member 16 rotates in a manner following development roller 17 at a speed equal to that of development roller 17 in a with direction (a direction shown with an arrow dl) with respect to development roller 17 and draw-up roller 15 rotates in a manner following smoothing member 16 at a speed equal to that of smoothing member 16 in a with direction (a direction shown with an arrow e1) with respect to smoothing member 16. An amount of developer supplied from smoothing member 16 to development roller 17 is decreased.

According to the feature as well, in a case where the development process is continuously performed, in supplying the developer from development roller 17 to image portion region P1, P2, a proper amount of liquid pool can be formed and occurrence of uneven granularity can be suppressed. An amount of supply of the developer to inter-image region Q1, Q2 is decreased and formation of a liquid pool more than necessary is suppressed. Therefore, in a case where liquid development apparatus 6E is employed as well, a good image can be obtained in a stable manner during continuous image formation.

Embodiment 7

Figure 16:
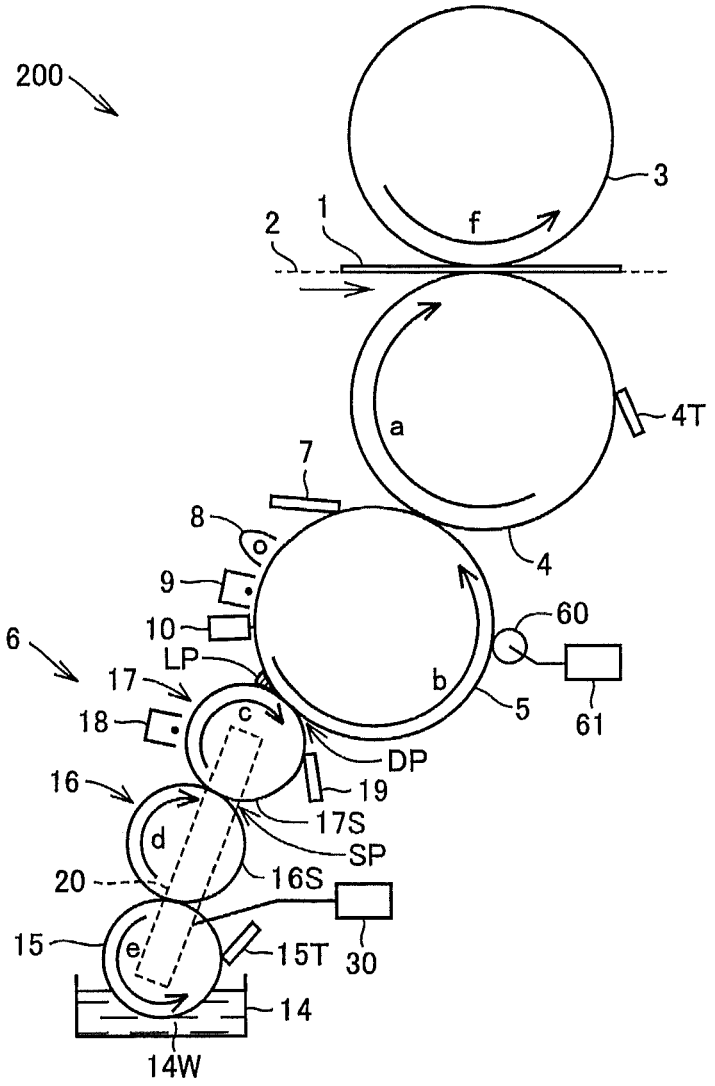
FIG. 16 is a diagram showing a wet-type image forming apparatus in Embodiment 7.

A wet-type image forming apparatus 200 in the present embodiment will be described with reference to FIG. 16. Wet-type image forming apparatus 200 includes a cleaning member 60 and a control unit 61 in addition to the features of wet-type image forming apparatus 100 (see FIG. 1) in Embodiment 1 described above. Cleaning member 60 is arranged at a position upstream of a portion of abutment (a primary transfer portion) between photoconductor 5 and intermediate transfer element 4 in a direction of rotation of photoconductor 5 and downstream of development position DP in the direction of rotation of photoconductor 5. Cleaning member 60 may be formed from a member like a roller as shown in FIG. 16 or may be formed from a member like a blade.

Control unit 61 causes cleaning member 60 to move away from photoconductor 5 while cleaning member 60 is opposed to the image portion region (P1, P2). A toner image is not distorted by cleaning member 60. Control unit 61 causes cleaning member 60 to abut to photoconductor 5 at prescribed timing when cleaning member 60 is opposed to the inter-image region (Q1, Q2). A liquid pool carried on the inter-image region (Q1, Q2) is removed from photoconductor 5 by cleaning member 60.

Wet-type image forming apparatus 200 can suppress contamination of the inside of the apparatus or a defect caused in a subsequent step due to scattering of a liquid pool carried on the inter-image region (Q1, Q2) on photoconductor 5.

It is noted that cleaning member 60 can also be formed from what is called a squeezing member. The squeezing member is formed like a roller and can wipe off only a carrier solution from the surface of photoconductor 5. Even when the squeezing member abuts to the image portion region, a toner image in the image portion region is hardly distorted by the squeezing member. In a case where a squeezing member is employed as cleaning member 60, control unit 61 desirably causes cleaning member 60 to abut to or move away from photoconductor 5 as necessary. On the other hand, in a case where cleaning member 60 is formed from a member like a blade, a toner image in the image portion region may be distorted by cleaning member 60. Therefore, control unit 61 desirably causes cleaning member 60 to abut to or move away from photoconductor 5 at prescribed timing.

Embodiment 8

Figure 17:
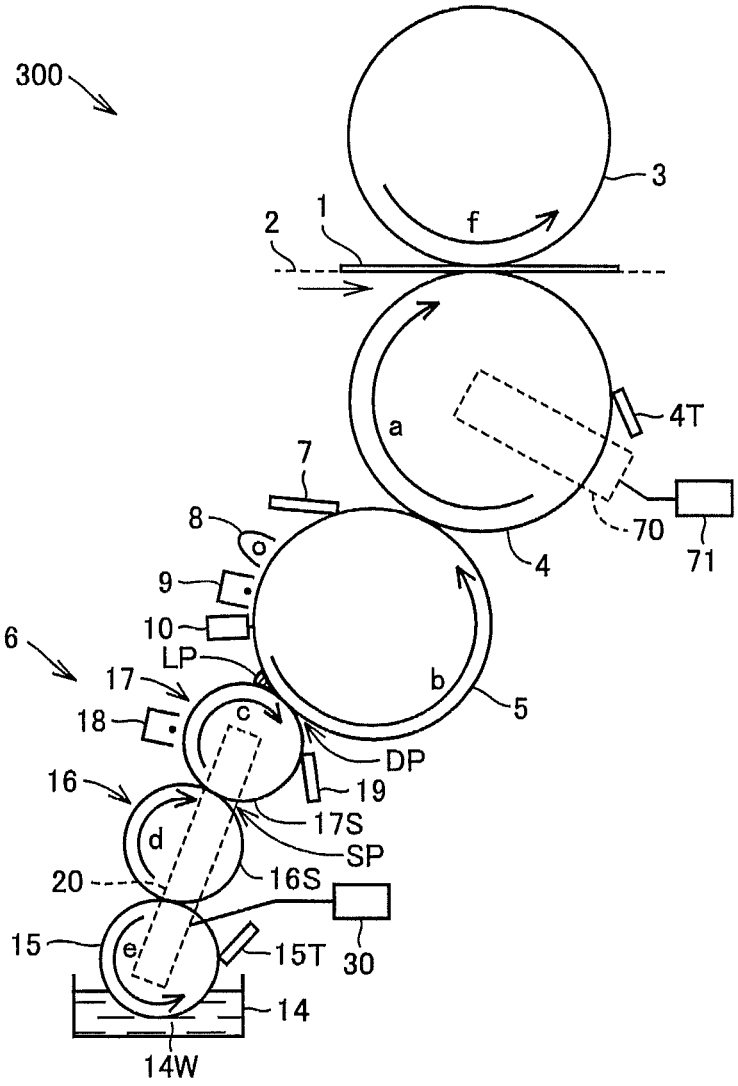
FIG. 17 is a diagram showing a wet-type image forming apparatus in Embodiment 8.

A wet-type image forming apparatus 300 in the present embodiment will be described with reference to FIG. 17. Wet-type image forming apparatus 300 includes a drive mechanism 70 (a second drive mechanism) and a control unit 71 in addition to the features of wet-type image forming apparatus 100 (see FIG. 1) in Embodiment 1 described above. Drive mechanism 70 varies a distance between intermediate transfer element 4 and photoconductor 5 and causes intermediate transfer element 4 and photoconductor 5 to abut to each other or moves intermediate transfer element 4 and photoconductor 5 away from each other.

Control unit 71 causes intermediate transfer element 4 and photoconductor 5 to pressure-contact with each other with prescribed pressure-contact force (second pressure-contact force) while intermediate transfer element 4 is opposed to the image portion region (P1, P2) on photoconductor 5. Control unit 71 causes intermediate transfer element 4 and photoconductor 5 to pressure-contact with each other with prescribed pressure-contact force (second pressure-contact force) or causes intermediate transfer element 4 and photoconductor 5 to move away from each other at prescribed timing when intermediate transfer element 4 is opposed to the inter-image region (Q1, Q2) on photoconductor 5.

According to wet-type image forming apparatus 300, a liquid pool carried on the inter-image region (Q1, Q2) passes between photoconductor 5 and intermediate transfer element 4 and is removed by cleaning blade 7. Contamination of the inside of the apparatus or a defect caused in a subsequent step due to scattering of the liquid pool carried on the inter-image region (Q1, Q2) on photoconductor 5 can be suppressed.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A liquid development apparatus for developing by using a developer containing a carrier solution and toner, electrostatic latent images included in a plurality of image portion regions, each of the plurality of image portion regions corresponding to a respective one of a plurality of sheets, the plurality of image portion regions being formed successively on an image carrier with an inter-image region being interposed, the inter-image region corresponding to a region between one of the plurality of image portion regions and a next one of the plurality of image portion regions, comprising:

a developer carrier for transporting said developer to a development position opposed to said image carrier and developing said electrostatic latent image while it abuts to said image carrier, only one developer carrier being provided such that one-to-one relation with single said image carrier is established; and a control unit for carrying out prescribed control such that an amount of both the carrier solution and the toner of said developer supplied from said developer carrier to said inter-image region on said image carrier is reduced or set to zero.

2. The liquid development apparatus according to claim 1, further comprising a first drive mechanism for varying a distance between said developer carrier and said image carrier, wherein said first drive mechanism controlled by said control unit pressure-contacts said developer carrier and said image carrier with each other with first pressure-contact force while said developer carrier is opposed to said image portion region and increases a distance between said developer carrier and said image carrier or moves said developer carrier and said image carrier away from each other such that pressure-contact force between said developer carrier and said image carrier is smaller than said first pressure-contact force at prescribed timing when said developer carrier is opposed to said inter-image region.

3. The liquid development apparatus according to claim 1, further comprising a developer supply portion for supplying said developer to said developer carrier through a supply position, wherein said developer supply portion controlled by said control unit supplies a prescribed amount of said developer to said developer carrier while a first potentially opposing portion in a surface of said developer carrier, which will be opposed to said image portion region, is located at said supply position and supplies said developer in an amount smaller than said prescribed amount to said developer carrier or supplies no said developer to said developer carrier at prescribed timing when a second potentially opposing portion in the surface of said developer carrier, which will be opposed to said inter-image region, is located at said supply position.

4. The liquid development apparatus according to claim 3, wherein said developer supply portion includes an abutment member for supplying said developer to said developer carrier while it abuts to said developer carrier, and said abutment member abuts to said developer carrier while said first potentially opposing portion of said developer carrier is located at said supply position and said abutment member moves away from said developer carrier at prescribed timing when said second potentially opposing portion of said developer carrier is located at said supply position.

5. The liquid development apparatus according to claim 3, wherein said control unit drives said developer supply portion while said first potentially opposing portion of said developer carrier is located at said supply position and said control unit stops drive of said developer supply portion at prescribed timing when said second potentially opposing portion of said developer carrier is located at said supply position.

6. A wet-type image forming apparatus, comprising:

an image carrier;

a transfer target member arranged to abut to said image carrier;

a second drive mechanism for varying a distance between said image carrier and said transfer target member; and said liquid development apparatus according to claim 1, said second drive mechanism pressure-contacting said image carrier and said transfer target member with each other with second pressure-contact force while said transfer target member is opposed to said image portion region and increasing a distance between said image carrier and said transfer target member or moving said image carrier and said transfer target member away from each other such that pressure-contact force between said image carrier and said transfer target member is smaller than said second pressure-contact force at prescribed timing when said transfer target member is opposed to said inter-image region.

7. A wet-type image forming apparatus, comprising:

an image carrier;

a transfer target member arranged to abut to said image carrier;

said liquid development apparatus according to claim 1; and a cleaning member arranged at a position upstream of a portion of abutment between said image carrier and said transfer target member and downstream of said development position, said cleaning member moving away from said image carrier while said cleaning member is opposed to said image portion region and abutting to said image carrier at prescribed timing when said cleaning member is opposed to said inter-image region.

8. The liquid development apparatus according to claim 1, wherein the control unit is configured to set to zero the amount of said developer supplied from said developer carrier to said inter-image region on said image carrier.

9. The liquid development apparatus according to claim 1, wherein the control unit is configured for carrying out the prescribed control during a development process.

* * * * *